United States Patent [19]

Tsujihara

[11] Patent Number: 4,692,020

[45] Date of Patent: Sep. 8, 1987

[54] SHEET REVERSING IN COPYING MACHINE AND OTHER SHEET-HANDLING MACHINES

[75] Inventor: Sotohiro Tsujihara, Tokyo, Japan

[73] Assignee: Ricoh Company, Ltd., Tokyo, Japan

[21] Appl. No.: 799,265

[22] Filed: Nov. 18, 1985

[30] Foreign Application Priority Data

Nov. 17, 1984 [JP] Japan ..... 59-174684[U]

[51] Int. Cl.[4] ..... G03G 21/00

[52] U.S. Cl. ..... 355/14 SH; 271/186; 271/291; 271/902; 355/3 SH; 355/24

[58] Field of Search ..... 355/23, 24, 35 H, 14 SH; 271/184, 186, 304, 291, 902

[56] References Cited

U.S. PATENT DOCUMENTS

| | | | |
|---|---|---|---|
| 3,833,911 | 9/1974 | Caldwell et al. | 355/24 X |
| 3,856,295 | 12/1974 | Looney | 355/24 X |
| 3,885,664 | 5/1975 | Fujimura | 271/184 |
| 4,078,789 | 3/1978 | Kittredge et al. | 271/186 X |
| 4,385,825 | 5/1983 | Kaneko | 355/3 SH |
| 4,579,326 | 4/1986 | Pinckney et al. | 271/291 X |

FOREIGN PATENT DOCUMENTS

| | | | |
|---|---|---|---|
| 59-22848 | 2/1984 | Japan | 271/184 |

OTHER PUBLICATIONS

Bar-On, Ari, "Paper Path for Automatic Duplex", Xerox Discl. Journal, vol. 2, No. 3, May/Jun. 1977, pp. 79-80.

*Primary Examiner*—Arthur T. Grimley
*Assistant Examiner*—Jane K. Lau
*Attorney, Agent, or Firm*—Cooper, Dunham, Griffin & Moran

[57] ABSTRACT

A sheet-reversing device suitable for use in copying machines and other sheet-handling machines has a main roller and a feed-in and a feed-out roller which are frictionally driven by the main roller. The axes of those rollers remain fixed with respect to each other. When a sheet is fed to the nip between the main roller and the feed-out roller, it is transported without reversing, but when fed up to the nip between the main roller and the feed-in roller, it enters into a switchback path and the formerly trailing edge of the sheet is fed to the nip between the main roller and the feed-out roller and then is reversely transported (trailing edge first). By selecting the appropriate inlet path, the sheet is selectively reversed.

11 Claims, 5 Drawing Figures

SHEET REVERSING IN COPYING MACHINE AND OTHER SHEET-HANDLING MACHINES

BACKGROUND AND SUMMARY OF THE INVENTION

This invention is in the field of machines such as copying machines, facsimile machines, printers, or the like. A particular aspect of the invention relates to a sheet-reversing device for such machines.

FIG. 3 and FIG. 4 show one example of a conventional, prior art sheet-reversing device which comprises a main reversing roller 8*a* driven to rotate in a counterclockwise direction, a reverse roller 10*a* which is disposed upstream of the inlet sheet passage, and a reverse roller 9*a* which is disposed downstream of the same sheet passage. The reverse rollers 10*a* and 9*a* are in frictional contact with the peripheral surface of the main reversing roller 10 to be rotated thereby.

One mode of operation is called a "reverse mode." In this mode, the sheet is reversed such that it moves with its formerly trailing edge first. The reverse rollers 10*a* and 9*a* are spaced from each other as shown in FIG. 3. The sheet (not shown) is transported to the nip between the main reversing roller 8*a* and the reverse roller 10*a*, and then is fed to a switchback path 19*a* shown by the arrow D. After the trailing edge of the sheet passes the nip between the rollers 8*a* and 10*a*, the transporting direction of the sheet is changed to an opposite direction. Therefore, the sheet is pushed backward from the switchback path 19*a* and then is transported to the nip between the reverse roller 9*a* and the main reversing roller 8*a* as shown by the arrow E, and then is transported to a passage 18*a* as shown by the arrow B or to the other passage 17*a* as shown by the arrow F.

Another mode is called a "normal mode." In this mode, the sheet is not reversed; the reverse roller 10*a* and the reverse roller 9*a* are moved to a position as close as possible to each other while still contacting the main reversing roller 8*a* as shown in FIG. 4. Therefore, the sheet is not transported to the switchback path 19*a* shown by the arrow A, but is allowed to enter the nips between the reverse rollers 10*a* and 9*a* and the main reversing roller 8*a*. After that, the sheet is transported to either the direction B or the direction F.

Although the reversing or non-reversing of the sheet can be controlled by whether or not the sheet enters into the switchback path 19*a* as described above, there are disadvantages such as higher cost and structural complications, since the reverse roller 9*a* and 10*a* have to be moved between the position shown in FIG. 3 and that shown in FIG. 4 in order to change between the above-described two modes.

Further, as shown in FIG. 5, a sheet-reversing device is known in which the reverse roller 10*b* and the reverse roller 9*b* are in frictional contact with the main reverse roller 8*b* to be rotated thereby. The axes of rotation of rollers 10*b* and 9*b* are fixed with respect to each other.

When the sheet is to be reversed by this sheetreversing device, it enters into the sheet inlet path 14*b* shown by the arrow C as in the case of FIG. 3, and enters the nip between the rollers 8*b* and 10*b* to be transported to the switchback path 19*b* (the arrow D). The sheet then enters the nip between the rollers 8*b* and 9*b* with reversing. After that, the sheet is transported to either the passage 18*b* or the passage 17*b* (the arrow B or F).

When the sheet is not to be reversed, the sheet is transported to sheet path 15*b* (the arrow A) which branches from the sheet inlet path 14*b*, and then is directly transported to either the passage 17*b* or the passage 18*b* without passing through the sheet inlet path 14*b* and the switchback path 19*b*. The numeral 30 shows a pair of intermediate rollers disposed in the branched sheet path 15*b*.

Although there is no need for moving the reverse roller 10*b* and the reverse roller 9*b* in this device, the branching sheet path 15*b* has to be designed so as to bypass the roller 8*b*, 9*b* and can become undesirably long. Further, this device needs intermediate rollers, such as a pair of driving rollers 30, 30. Therefore, disadvantages such as higher cost and enlarging the whole structure of the sheet reversing mechanism still remain.

Accordingly, the invention is directed to arranging an apparatus having a sheet-reversing function in copying machines and other sheet-handling machines to enhance the desirable and suppress the undesirable characteristics thereof and to provide features not attained in the prior art.

In a nonlimiting example of an embodiment of the invention, a feed-in roller and a feed-out roller are frictionally driven by a main roller, and the axes of said rollers remain fixed. A normal sheet inlet guides a sheet to the nip between the feed-out roller and the main roller, and the sheet is transported from said nip to an outlet path without reversing. A reverse sheet inlet guides the sheet to the nip between the feed-in roller and the main roller, and the sheet is fed to a switchback path which extends from this nip in a direction away from those of the normal sheet inlet and the outlet path. After the trailing edge of the sheet clears the nip, the formerly trailing edge of the sheet is fed toward the nip between the main roller and the feed-out roller. The sheet is transported to the outlet path with reversing (trailing edge first). A sheet inlet switch is provided to change selectively between the normal sheet inlet and the reverse sheet inlet.

The apparatus can achieve a compact and inexpensive construction by eliminating the need to move the axes of the two reverse rollers and the need for a long sheet bypass path which has a pair of transporting rollers. Furthermore, the angle at which the sheet enters the nips between the rollers can be maintained constant to enhance the reliability of sheet transportation.

These and other features of the present invention will become apparent from the following detailed description of an embodiment thereof taken in conjunction with the accompanying drawings.

DETAILED DESCRIPTION

Figure 1:
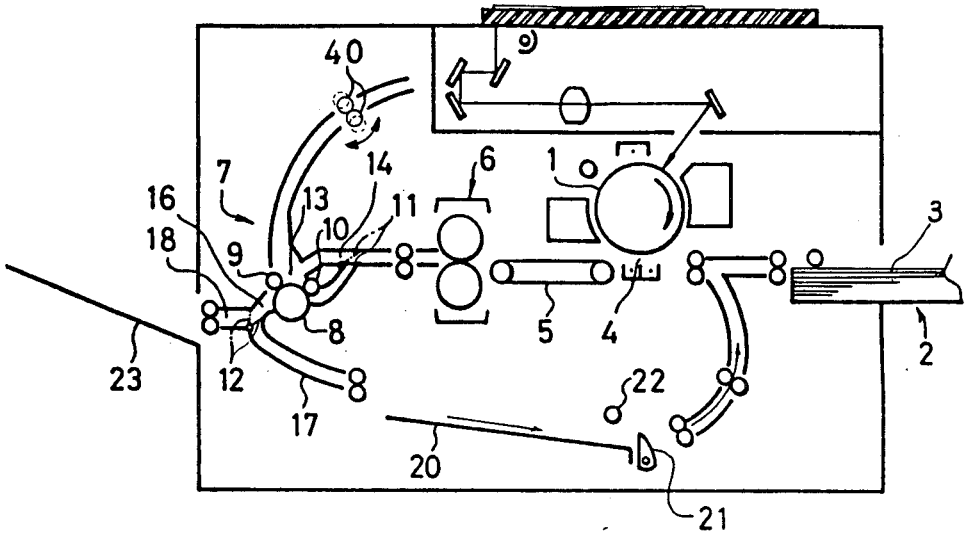
FIG. 1 shows a schematic sectional view of a duplex copying machine having a sheet-reversing device in accordance with an embodiment of the present invention.
Figure 2:
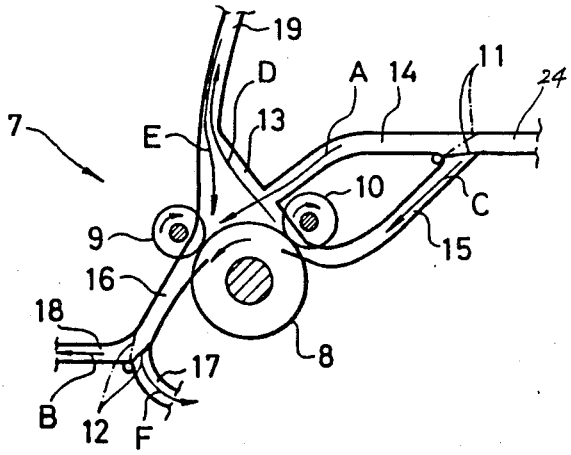
FIG. 2 shows an enlarged view of the sheetreversing device shown in FIG. 1.
Figure 3:
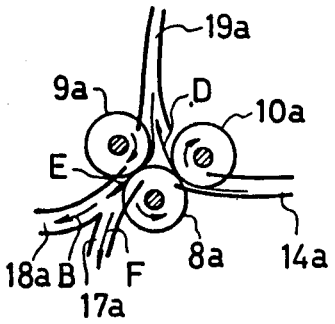
FIG.3 PRIOR ART
FIG. 3 to FIG. 5 are sectional views showing prior art sheet-reversing devices.
Figure 4:
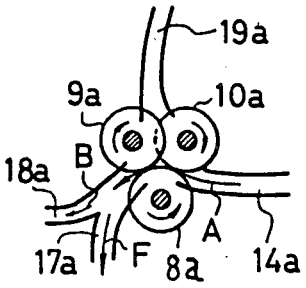
FIG.4 PRIOR ART
Figure 5:
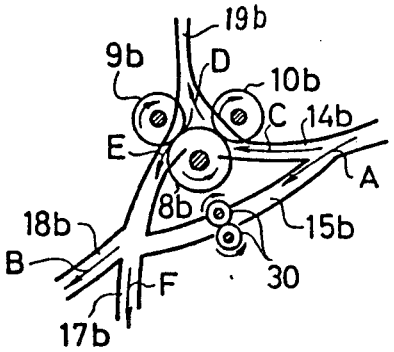
FIG.5 PRIOR ART

Referring to FIG. 1 and FIG. 2, exemplary embodiments of a sheet-reversing device according to the present invention will now be described.

FIG. 1 shows pertinent parts of one embodiment of a duplex copying machine in which a sheet-reversing device according to the present invention can be applied. In FIG. 1, a toner image is formed by an image-forming means comprising a photoconductive drum 1 which rotates in clockwise direction by using the well-known electrophotographic process, and the toner image is transferred to a sheet 3 which is fed from a sheet supply device 2 to an image transfer section 4, and then is transported to the left by a transportation belt 5. The sheet is then transported to an image-fixing device 6, where the toner image is fixed. The sheet then is transported to a sheet-reversing device 7 constructed and operated according to one example of the present invention, and then is transported to a sheetdischarging tray 23 or to a re-feeding means comprising an intermediate tray 20.

The sheet-reversing device 7 comprises a main roller 8, which is rotated in a counterclockwise direction, a feed-in roller 10, and a feed-out roller 9. Rollers 10 and 9 are spaced from each other, and are in frictional contact with the peripheral surface of the main roller 8 to be driven thereby. The axes of rotation of rollers 8, 9 and 10 are and remain fixed with respect to each other. The sheet which passes the image-fixing device 6 is transported to a main sheet inlet 24, and from it into a normal sheet inlet 14 or to a reverse sheet inlet 15 which branches from the main sheet inlet 24. The normal sheet inlet 14 guides the sheet to a chamber 13, which is between the feed-in roller 10 and the feed-out roller 9, and is above main roller 8. Reverse sheet inlet 15 guides the sheet to the nip between the main roller 8 and the feed-in roller 10. At the point where the normal sheet inlet 14 and the reverse sheet inlet 15 branch from the main sheet inlet path 24, there is an inlet switch 11 having a switchable guide member which is supported to be movable from the normal position shown by the solid line and the reverse position shown by the dot-and-dash line, so that the sheet can be selectively guided from the main sheet inlet 24 into the normal sheet inlet 14 or the reverse sheet inlet 15.

An outlet path 16 is provided to extend from the nip between the main roller 8 and the feed-out roller 9 downstream in the sheet-transporting direction. A sheet discharge path 18 and a sheet recycle path 17 branch from the outlet path 16. The sheet discharge path 18 guides the sheet from the outlet path 16 to the sheet discharge tray 23, and the sheet recycle path 17 guides the sheet from the outlet path 16 to the re-feeding means which includes the intermediate tray 20. An outlet switch 12, having a switchable guide member which is moved between the discharge position shown by the solid line and the recycle position shown by the dot-and-dash line, is provided where the discharge and recycle paths 18 and 17 branch from the outlet path 16. A switchback path 19 extends from chamber 13 in a direction different from those of the normal sheet inlet 14 and the outlet path 16, that is, extends in an upward direction in the example shown in the figures. A pair of reversible rollers 40, 40 is disposed in the switchback path 19. Rollers 40, 40 are out of contact with each other under normal conditions. However, after the trailing edge of the sheet clears the nip between the main sheet roller 8 and the feed-in roller 10, these rollers 40, 40 are brought into contact with each other and rotate in an expelling direction to feed the sheet, formerly trailing edge first, out of the switchback path 19 and toward the nip between the main roller 8 and the feed-out roller 9.

The machine can operate in a "normal mode," in which an image is formed on only one side of a copy sheet, and the sheet is discharged to the sheet discharge tray 23. When the normal mode is selected, the inlet switch 11 is in the normal position shown by the solid line, in which it closes the reverse sheet inlet 15. Therefore, the sheet which passes through the image-fixing device 6 is guided from the main sheet inlet 24 to the normal sheet inlet 14, as shown by the arrow A, and reaches the chamber 13 without contacting the feed-in roller 10. Rollers 8 and 9 then engage its leading edge and feed it into the outlet path 16, leading edge first. In the normal mode, the outlet switch 12 is in its discharge position shown by the solid line, to guide the sheet to the sheet discharge tray 23 through the sheet discharge path 18, as shown by the arrow B. The image side faces upwardly in discharge tray 23.

The machine has another mode, called a "combined images mode," in which two or more images are formed on the same side of the copy sheet. The images can be different, or the same image can be formed on different parts of the copy sheet. In this mode, the sheet coming from the image-fixing device 6 passes through the main sheet inlet 24 and then is guided to the normal inlet 14 by the inlet switch 11 as in the case of the "normal mode." However, in the case of this "combined images mode," the outlet switch 12 is moved to its recycle position shown by the dot-and-dash line, by means of a solenoid or the like (not shown). The sheet therefore goes to the sheet recycle path 17 (the arrow F), and then is fed into the intermediate tray 20. The sheet is stacked on the intermediate tray 20, image face down. A finger 21 helps keep the sheet in the proper stacked position. When it is time to add an image to that sheet, finger 21 retracts and re-feeding roller 22 engages the sheet to re-feed it to the image transfer section 4 at which a new toner image is formed on the same surface of the sheet on which a previous image was formed. After said toner image is fixed on the sheet by the toner fixing device 6, the sheet is discharged to the sheet discharge tray 23 through the sheet-reversing device 7 as in the case of "normal mode." The image side faces up in the sheet discharge tray 23.

In yet another mode, called a "duplex mode," images are formed on both sides of the sheet. For this mode, the inlet switch 11 is moved from its normal position to the reverse position, shown by the dot-and-dash line, by means of a solenoid or the like (not shown). The sheet therefore is guided from the main sheet inlet 24 into the reverse sheet inlet 15, shown by the arrow C, and reaches the chamber 13 after passing through the nip between the feed-in roller 10 and the main roller 8. It enters the switchback path 19 as shown by the arrow D. After the trailing edge of the sheet clears the nip between the main roller 8 and the feed-in roller 10, the pair of reversible rollers 40, 40, which are out of contact with each other until then, are brought into rotating pressure contact to engage and expel the sheet. The sheet is thus transported in the opposite direction (the arrow E) from the direction shown by the arrow D. As a result, the previously trailing edge of the sheet becomes a leading edge, so that the sheet moves "trailing edge first," and is engaged by the nip between the feed-out roller 9 and the main roller 8 and fed into the outlet path 16. For this mode, the outlet switch 12 has been moved from its discharge position to its recycle position shown by the dot-and-dash line. Therefore, the sheet is guided from the outlet path 16 to the sheet recycle path 17 and then is transported to the intermediate tray 20. It is stacked on the intermediate tray 20, image face up.

When it is time to form another toner image on the other side of the same sheet, it is fed by the re-feeding roller 22 from the intermediate tray 20 to the image transfer section 4, where a new toner image is formed on the opposite surface of the sheet. After said toner image is fixed on the sheet by the toner fixing device 6, the sheet is discharged to the sheet discharge tray 23 as in the case of the "normal mode." The first-formed image faces down in the sheet discharge tray 23, and the second-formed image on the same sheet faces up.

Yet another mode is called a "reverse sheet discharging mode." In this mode, the sheet is discharged into the sheet-discharging tray 23 image side down (if images have been formed on both sides of the sheet, in the duplex mode, then the later-formed image faces down when the reverse mode is selected). In this mode, the sheet is transported to the outlet path 16 after passing through the switchback path 19, as in the case of the "duplex mode." The outlet switch 12 is in its discharge position, as shown by the solid line, and therefore the sheet is discharged into the sheet-discharging tray 23 through the sheet discharge path 18 in such a manner that the sheet is reversed; that is, the image side faces down (if only one side has an image). If the sheet has been processed through the duplex mode, then the discharge is such that the later-formed image faces down in the sheet discharge tray 23.

As explained above, the sheet can be transported with reversing selectively by the sheet-reversing device 7 according to the selected one of the above-mentioned copying modes.

Normally, the sheet is discharged to the discharge tray 23 without further reversing after the completion of the cycle of "duplex mode" or "combined images mode." However, if either the duplex mode or the combined images mode is selected together with the reverse sheet discharge mode, the sheet-reversing device 7 operates once more to ensure that the sheet is discharged into the sheet discharge tray 23 such that the image most recently formed thereon faces down.

The above-described embodiments show examples in which the sheet is transported with reversing or without reversing according to the "normal mode," the "reverse sheet discharging mode," the "duplex mode," or the "combined images mode." However, the present invention can be used when less than all four modes are provided. For example, the sheet-reversing device can be used in a machine which has only the "normal mode" and the "reverse sheet discharging mode." In this case, the outlet switch 12 is not required. Further, it should be clear that the above-described sheet-reversing device can be employed in equipment other than copying machines including but not limited to printers, facsimile machines, and other sheet-handling machines. In the case of copying machines, a sheet-reversing device in accordance with the invention can be used advantageously with equipment for selectively reversing the originals which are being copied, instead of, or in addition to, its use in connection with copy sheets.

I claim:

1. Apparatus comprising:

a main sheet inlet for receiving sheets leading edge first, which branches into a normal sheet inlet and a reverse sheet inlet, an inlet switch which is located at the branching point and has a normal position for directing the sheets leading edge first into the normal sheet inlet and a reversing position for directing the sheets leading edge first into the reverse sheet inlet, a switchback path, and an outlet path;

a main roller rotating in a selected direction;

a feed-in roller which is in rotational contact with the main roller adjacent the reverse sheet inlet to feed sheets therefrom into the switchback path leading edge first; and a feed-out roller which is in rotational contact with the main roller adjacent the normal sheet inlet and the switchback path, to feed sheets from the normal sheet inlet into the outlet path leading edge first and to feed sheets which have been fed into the switchback path leading edge first, from the switchback path into the outlet path trailing edge first;

wherein a sheet fed leading edge first into the main sheet inlet travels, depending on the position of the inlet switch, either (i) into the normal sheet inlet leading edge first, then into the nip between the main roller and the feed-out roller and then into the outlet path leading edge first, or (ii) into the reverse sheet inlet leading edge first, then into the nip between the main roller and the feed-in roller, then into the switchback path leading edge first, then out of the switchback path trailing edge first and into the nip between the main roller and the feed-out roller trailing edge first and then into the outlet path trailing edge first.

2. Apparatus as in claim 1 including sheet feeding means, image forming means receiving sheets from said feeding means to form images on said sheets and to feed the sheets to said main sheet inlet, and a sheet discharge tray for receiving sheets from said outlet path.

3. Apparatus as in claim 1 including means for forming images on the sheet by an electrostatic copying process and means for selectively supplying the sheets with images thereon to the normal sheet inlet and the reverse sheet inlet.

4. Apparatus as in claim 1 in which in its normal position the inlet switch closes the reverse sheet inlet to guide sheets from the main sheet inlet into the normal sheet inlet and in its reversing position the inlet switch closes the normal sheet inlet to guide sheets from the main sheet inlet into the reverse sheet inlet.

5. Apparatus as in claim 4 including a sheet discharge path and a sheet recycle path branching from said sheet outlet path, and an outlet switch which is located where the discharge and recycle paths branch from the outlet path and selectively guides sheets from the outlet path into the discharge path or into the recycle path.

6. Apparatus as in claim 5 in which the outlet switch has a discharge position in which it closes the recycle path and guides sheets from the outlet path into the discharge path and has a recycle position in which it closes the discharge path and guides sheets from the outlet path into the recycle path.

7. Apparatus as in claim 6 including sheet feeding means, image forming means which is disposed to receive sheets from said feeding means to form images on said sheets and to feed the sheets to said main sheet inlet, sheet re-feeding means for feeding sheets from the recycle path to the image forming means, and a sheet discharge tray disposed adjacent the discharge path to receive sheets from said discharge path, wherein the apparatus is selectively operable in a normal mode in which the inlet switch is in its normal position and the outlet switch is in its discharge position, to form images on one side of said sheets, a duplex mode in which the inlet switch is in its reverse position and the outlet switch is in its recycle position, to form images on both sides of said sheets, a combined images mode in which the inlet switch is in its normal position and the outlet switch is in its recycle position, to form a plurality of images on the same side of each of said sheets, and a reverse sheet discharging mode in which the inlet switch is in its reverse position and the outlet switch is in its discharge position, to form images on one side of said sheets and discharge the sheet with the image side thereof facing the opposite way from those discharged in said normal mode.

8. Apparatus as in claim 1 in which both the feed-in roller and the feed-out roller are frictionally driven by the main roller.

9. Apparatus as in claim 1 in which the axes of the feed-in roller, the feed-out roller and the main roller are fixed with respect to each other.

10. Apparatus as in claim1 including a pair of reversible rollers which are disposed in the switchback path and are normally out of contact with each other but are brought into contact after the leading edge of a sheet passes between them and the trailing edge of the sheet clears the feed-in roller, and then rotate in an expelling direction to feed the trailing edge of the sheet out of the switchback path and toward the point of engagement between the feed-out roller and the main roller.

11. Apparatus as in claim 10 including a sheet recycle path branching from said sheet outlet path, and an outlet switch which is located where the recycle path branches from the outlet path and selectively guides sheets from the outlet path into the recycle path.

* * * * *